US011454191B2

(12) United States Patent
Bauer et al.

(10) Patent No.: US 11,454,191 B2
(45) Date of Patent: Sep. 27, 2022

(54) METHOD FOR OPERATING AN INTERNAL COMBUSTION ENGINE FOR A MOTOR VEHICLE, AND INTERNAL COMBUSTION ENGINE FOR A MOTOR VEHICLE

(71) Applicant: Daimler AG, Stuttgart (DE)

(72) Inventors: Joerg Bauer, Esslingen (DE); Herbert Zoeller, Stuttgart (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 17/269,731

(22) PCT Filed: Aug. 1, 2019

(86) PCT No.: PCT/EP2019/070837
§ 371 (c)(1),
(2) Date: Feb. 19, 2021

(87) PCT Pub. No.: WO2020/038702
PCT Pub. Date: Feb. 27, 2020

(65) Prior Publication Data

US 2021/0239072 A1 Aug. 5, 2021

(30) Foreign Application Priority Data

Aug. 22, 2018 (DE) ..... 10 2018 006 635.6

(51) Int. Cl.
*F02F 3/26* (2006.01)
*F02B 23/06* (2006.01)
*F02B 23/10* (2006.01)

(52) U.S. Cl.
CPC ..... *F02F 3/26* (2013.01); *F02B 23/0669* (2013.01); *F02B 23/0624* (2013.01);
(Continued)

(58) Field of Classification Search
CPC ..... F02B 23/0651; F02B 23/0693; F02B 23/0669
See application file for complete search history.

(56) References Cited

U.S. PATENT DOCUMENTS 7,942,126 B2 * 5/2011 Zoller ..... F02B 23/0693 123/298
10,024,222 B2 * 7/2018 Martinez ..... F02B 23/0669
(Continued)

FOREIGN PATENT DOCUMENTS

CN 101460722 A 6/2009
CN 103477064 A 12/2013
(Continued)

OTHER PUBLICATIONS

English Machine translation of description provided by Espacnet of JP-2013177844-A (Year: 2021).*
(Continued)

*Primary Examiner* — Michael A Kessler
(74) *Attorney, Agent, or Firm* — Crowell & Moring LLP

(57) ABSTRACT

A method for operating an internal combustion engine of a motor vehicle having a cylinder, the combustion chamber of which is delimited in the radial direction by a cylinder wall and in the axial direction by a piston and by a combustion chamber roof. The piston has an annularly peripheral piston stage which is arranged axially recessed in the piston compared with an annularly peripheral piston crown and which merges via an annularly jet splitter contour into a piston hollow arranged axially recessed in the piston in relation to the piston stage. An injector is allocated to the cylinder and via the injector several injection jets are simultaneously injected directly into the combustion chamber in a star shape for a combustion process.

5 Claims, 2 Drawing Sheets

(52) U.S. Cl.
CPC ..... *F02B 23/0651* (2013.01); *F02B 23/0672* (2013.01); *F02B 2023/108* (2013.01)

(56) References Cited

U.S. PATENT DOCUMENTS

| | | | | |
|---|---|---|---|---|
| 2009/0095251 | A1 | 4/2009 | Zoller | |
| 2014/0048036 | A1 | 2/2014 | Zoeller et al. | |
| 2014/0305402 | A1* | 10/2014 | Zoeller | F02B 23/0693 123/294 |
| 2017/0051657 | A1 | 2/2017 | Martinez et al. | |
| 2017/0096978 | A1 | 4/2017 | Martinez et al. | |
| 2020/0340391 | A1* | 10/2020 | Machold | F02B 23/0618 |

FOREIGN PATENT DOCUMENTS

| | | | | | |
|---|---|---|---|---|---|
| CN | 104295398 | A | | 1/2015 | |
| CN | 105940200 | A | | 9/2016 | |
| CN | 107076007 | A | | 8/2017 | |
| DE | 10 2006 020 642 | A1 | | 11/2007 | |
| DE | 10 2011 017 479 | A1 | | 10/2012 | |
| DE | 10 2011 119 215 | A1 | | 5/2013 | |
| DE | 10 2016 009 971 | A1 | | 2/2018 | |
| JP | 2004-190572 | A | | 7/2004 | |
| JP | 2004190572 | A | * | 7/2004 | |
| JP | 2004190573 | A | * | 7/2004 | F02B 23/0669 |
| JP | 2013-177844 | A | | 9/2013 | |
| JP | 2013177844 | A | * | 9/2013 | |
| WO | WO 2015/162005 | A1 | | 10/2015 | |
| WO | WO 2017/152203 | A1 | | 9/2017 | |
| WO | WO 2018/033232 | A1 | | 2/2018 | |

OTHER PUBLICATIONS

English machine translation provided by Google translate relied on in the consideration of German Office Action issued in German application 10 2018 006 635.6 Apr. 26, 2019 seen cited in the IDS dated Feb. 29, 2021 (Year: 2021).*

PCT/ EP2019/070837, International Search Report dated Nov. 13, 2019 (Two (2) pages).

German-language German Office Action issued in German application No. 10 2018 006 635.6 dated Apr. 26, 2019 (Seven (7) pages).

Chinese Office Action issued in Chinese application No. 201980054381.2 dated Dec. 20, 2021, with partial English translation (Twenty-Four (24) pages).

* cited by examiner

METHOD FOR OPERATING AN INTERNAL COMBUSTION ENGINE FOR A MOTOR VEHICLE, AND INTERNAL COMBUSTION ENGINE FOR A MOTOR VEHICLE

BACKGROUND AND SUMMARY OF THE INVENTION

The invention relates to a method for operating an internal combustion engine for a motor vehicle. Furthermore, the invention relates to an internal combustion engine for a motor vehicle.

Such a method for operating an internal combustion engine for a motor vehicle and such an internal combustion engine are already known from DE 10 2011 119 215 A1. The method is a burning method, also referred to as a combustion method, according to which the internal combustion engine is operated in its fired operation. Here, the internal combustion engine has at least one cylinder whose combustion chamber is delimited in the radial direction of the cylinder by a cylinder wall, in the axial direction of the cylinder on one side by a piston received translationally moveably in the cylinder and in the axial direction of the cylinder on the other side by a combustion chamber roof of the internal combustion engine. The combustion chamber roof is formed, for example, by a cylinder head of the internal combustion engine. The piston has an annularly peripheral piston stage which is arranged axially recessed in the piston compared with an annularly peripheral piston crown and which merges via an annularly peripheral jet splitter contour into a piston hollow arranged axially recessed in the piston in relation to the piston stage.

Moreover, the internal combustion engine has at least one injector allocated to the cylinder, by means of which injector several injection jets are simultaneously injected directly into the combustion chamber in a star shape for a combustion process and preferably within a work cycle of the internal combustion engine. By means of the jet splitter contour, the injection jets are respectively divided into a first subset entering into the piston hollow, into a second subset entering via the piston stage into a region between the piston crown and the combustion chamber roof and into third subsets. The respective injection jet and thus the respective subset are formed from an in particular liquid fuel, by means of which the internal combustion engine is operated in its fired operation. Thus, the fuel is injected directly by means of the injector, in particular by forming the injection jets. The third subsets extend starting from the respective injection jets on both sides in the peripheral direction of the piston in opposite directions along the piston stage and collide between two adjacent injection jets inside the piston stage and are deflected radially inwards from the piston stage. Here, the first subset forms a first combustion front and the second subset forms a second combustion front. Furthermore, the third subsets respectively inwardly deflected together form a third combustion front radially inwardly into a gap between adjacent injection jets. By means of a resulting current in the combustion chamber formed at least from a swirl, a crushing gap current and a jet current, the injection jets are deflected up-jet or upstream of the jet splitter contour in the direction of the piston.

By means of this measure, the injection jets can be deflected towards the piston removed from the cylinder head during a beginning expansion stroke in a work cycle. As a result, the injection jets can also furthermore impinge upon the jet splitter contour when the pistons are removed from the cylinder head or upon on the piston in the region of the jet splitter contour in order to further distribute the respective injection jet into three subsets. In doing so, a longer period of time or an extended crankshaft angle is available for the optimum distribution of the respective injection jets. As a result of the variation of injection duration, pressure and timing, in particular of the start of the injection, third subsets can be generated reproducibly via an extended characteristic diagram region with sufficiently great fuel mass and fuel speed and thus with an impulse inherent to sufficiently large third subsets, such that the third combustion front is formed in a gap between two adjacent injection jets and thus can optimally use combustion air distributed spatially in the combustion chamber, whereby combustion can be improved and, in particular, soot emissions can be reduced. Furthermore, with the deflection of the injection jet according to the invention, the wetting of the cylinder wall with fuel of the second subset is at least greatly reduced, since the injection jet substantially impinges upon the jet splitter contour or on adjacent regions of the piston and does not coat the piston crown and impinge directly upon the cylinder wall. Moreover, the third subsets are separated from the respective injection jets by means of the piston stage, such that less fuel is available for the second subset, whereby the impulse inherent to the second subset becomes smaller and thus the penetration depth of the second subset is reduced. Moreover, the axial deflection of the second subset in the piston stage towards the cylinder head leads to a build-up of the second subset between the cylinder head and the piston, such that the fuel flowing through the injection into the second combustion front is reduced, whereby the radial expansion of the second subset or the second combustion front is restricted. Advantageously, by means of these two effects, contact of the second combustion front on the relatively cold cylinder or the cylinder wall can be minimized, such that unwanted heat transfer between the second combustion front with the cylinder wall can be greatly reduced, whereby soot formation from the second combustion front on the relatively cold cylinder wall can be reduced. Moreover, ablution of oil from the cylinder wall and an input of soot into the engine oil can be reduced.

Moreover, DE 10 2006 020 642 A1 discloses a method for operating a directly injecting, self-igniting internal combustion engine. Furthermore, an internal combustion engine is known from DE 10 2011 017 479 A1.

The object of the present invention is to develop a method and an internal combustion engine of the kind mentioned at the start in such a way that combustion of the injected fuel can be further improved and combustion air spatially distributed in the combustion chamber can be used in a further optimized manner.

In order to develop a method of the kind in such a way that a particularly optimized combustion can be achieved by a particularly high utilization of the combustion air present in a combustion chamber, it is provided according to the invention that, in the piston stage, i.e., in a stage chamber of the piston stage, first deflection means and/or second deflection means are arranged, wherein the injection jets are distributed by means of first deflection means in the piston stage into third subsets and/or the second deflection means deflect the respective third subset from the peripheral direction in the radial direction inwardly and thus, in particular, in the direction of the gaps between adjacent injection jets, in particular in the direction of the injector. The piston stage has, for example, a stage wall also referred to as a side wall, by means of which, for example, the piston stage or its stage chamber is delimited in the radial direction outwards at least partially, in particular at least predominantly or completely.

The respective first and/or the second deflection means protrude inwardly from the side wall in the radial direction, such that the respective deflection means is, for example, a protrusion or a nose, which protrudes in the radial direction inwardly into the stage chamber and here projects in the radial direction inwardly into the stage chamber. In particular, the first deflection means, for example, are arranged to be spaced apart from one another in the peripheral direction of the piston. Preferably, in the peripheral direction of the piston, the deflection means are arranged distributed evenly or respectively at an impingement point of the injection jets on the jet splitter contour in the piston stage or in the stage chamber. Advantageously, using the first deflection means, the injection jets striking the jet splitter contour can be supported in terms of their distribution in the peripheral direction in third subsets, such that smaller fuel masses of third subsets and/or third subsets of injection jets with low impulse in the piston stage also have a sufficiently high speed, whereby a third combustion front can form in a gap between two adjacent injection jets. Alternatively to or in combination with the first deflection means, the second deflection means are arranged to be spaced apart from one another in the peripheral direction of the piston. Preferably, the second deflection means are arranged to be distributed evenly and centrally in the piston stage or in the stage chamber between two adjacent injection jets in the peripheral direction of the piston. Advantageously, using the second deflection means, the third subsets can be supported in terms of their deflection radially inwardly, such that smaller fuel masses of third subsets also form a third combustion front in a gap between two adjacent injection jets when colliding, whereby the combustion is also improved with third subsets with respective smaller impulse. Advantageously, using the second deflection means, third subsets can also be supported in terms of their deflection radially inwardly, which are formed from the injection jets further removed from one another in the piston stage. Here, the injector injects fewer injection jets, such that an angle between adjacent injection jets and thus the distance between adjacent injection jets when impinging upon the piston stage is greater, whereby the third subsets collide at low speed because of the further distance in relation to one another and thus have a lower impulse.

Furthermore, it is provided according to the invention that the injection jets are injected directly into the combustion chamber in the form of first jet cones each with a first jet breakup. Furthermore, it is provided according to the invention that, by means of the injector, several second injection jets provided in addition to the first injection jets in the form of second jet cones are simultaneously injected directly into the combustion chamber for the combustion process. Here, the second injection jets are each injected with a second jet breakup different from the first jet breakup. For example, the at least one first jet breakup is smaller than the at least one second jet breakup.

By means of the jet splitter contour, at least the first injection jets, for example, are divided into the first subset, the second subset and the third subsets. Here, it can be provided that, by means of the jet splitter contour, only or exclusively the first injection jets are respectively divided into the first subset, the second subset and the third subsets based on the first injection jets and the second injection jets. The second injection jets are not divided into any more subsets, such that the second injection jets each form a fourth subset in the combustion chamber when viewed separately. Since the respective first injection jet is divided into the first subset, the second subset and the third subsets by means of the jet splitter contour, such that the first combustion front, the second combustion front and the third combustion front are formed, and the respective second injection jet injects a fourth subset, such that the fourth subset forms a fourth combustion front, the method according to the invention is a combustion method formed as a four-front combustion method according to which the internal combustion engine preferably formed as a reciprocating piston engine is operated in its fired operation. In the fired operation, a fuel-air mixture is formed in the combustion chamber by means of the four subsets together, the mixture being combusted, such that, in the fired operation, combustion processes proceed in the combustion chamber. Advantageously, the first injection jets from the first injection openings are used in order to form the first, second and third combustion front, such that a fourth combustion front can be formed with the second injection jets, whereby a further improved combustion is achieved and the combustion air spatially distributed in the combustion chamber is utilized in a further optimized manner.

Preferably, the internal combustion engine is a self-igniting internal combustion engine, such that the internal combustion engine is preferably a diesel engine. The respective injection jet and thus the respective subset or subsets is formed by means of an in particular liquid fuel, in particular a liquid diesel fuel, such that the fuel is injected directly into the combustion chamber by means of the injector by forming the injection jets, in particular within a respective work cycle of the internal combustion engine and the four subsets each combust in a diffusion combustion. Preferably, the internal combustion engine is formed as a four-stroke engine, such that the respective work cycle has exactly 720 degrees of crank angle. The fuel-air mixture previously mentioned thus comprises the fuel which, in particular within the respective work cycle, is injected directly into the combustion chamber by means of the injector. Furthermore, the fuel-air mixture comprises combustion air which flows into or is led into the combustion chamber. By means of the method according to the invention, a particularly advantageous and in particular effective combustion can be achieved by an optimized utilization of the combustion air present in the combustion chamber, such that soot emissions emerging by means of the diffusion combustion of the internal combustion engine formed as a diesel engine can be kept to a particularly low level. Moreover, a particularly efficient and thus fuel-efficient operation of the internal combustion engine can be depicted.

The injector has first injection openings, which are, for example, first injection bores, or are also referred to as first injection bores. The first injection jets are caused by the first injection openings, for example. In other words, a first part of the fuel to be injected into the combustion chamber within the respective work cycle, for example, is injected through the first injection openings and thus injected directly into the combustion chamber, whereby the first injection jets are injected into the combustion chamber. Furthermore, the injector has second injection openings provided in addition to the first injection openings, for example, which are second injection bores, for example, or are also referred to as second injection bores. The second injection jets are caused by means of the second injection openings. Thus, a second part of the fuel to be injected directly into the combustion chamber within the respective work cycle by means of the injector, for example, is injected by the second injection openings and thus injected directly into the combustion chamber via the second injection openings, whereby the second injection jets emerge or are injected directly into the combustion chamber. The first injection openings and the second injection openings here differ, for example, in terms of the respective geometries and/or alignments and/or arrangement in the injector, such that, by means of the first injection openings, the respective first jet breakup and, by means of the second injection openings, the second jet breakup different from the respective first jet breakup, are caused or generated. In particular, the first injection openings and the second injection openings are formed to cause different injection impulses of the injection jets. In other words, for example, the first injection jets and the second injection jets differ from one another in terms of their injection impulses, such that the respective first injection jet, for example, has a first injection impulse, and the respective second injection jet has a second injection impulse different from the respective first injection impulse. In particular, with different jet breakup, different impulses can be set. Here, a small jet breakup has a higher impulse than a large jet breakup. In doing so, a particularly advantageous distribution of the injected fuel can be ensured.

The first injection jets are injected directly into the combustion chamber in the shape of a star at least in relation to one another or at least when viewed one below the other.

In a further design of the invention, the jet breakup of the first injection jets is smaller than the jet breakup of the second injection jets. This means, for example, that the first injection jets are narrower along a respective first longitudinal central axis in their injection direction of the respective first injection jets than the respective second injection jets along a respective second longitudinal central axis in their injection direction of the respective second injection jets. In other words, the second injection jets, for example, are thus bushier or more bulbous with a thick jet lobe than the first injection jets and have a greater jet breakup with a further expansion transversely to its second longitudinal central axis than the first injection jets with a thin jet lobe, which has a smaller jet breakup with a smaller expansion transversely to its first longitudinal central axis. Thus, a particularly advantageous utilization of the combustion air present in the combustion chamber can be achieved. Advantageously, the second injection jets clearly reach less far into the combustion chamber than the first injection jets, such that the second injection jets expand in the close region of the injector, whereby the utilization of the combustion air present in the combustion chamber is further improved.

With the respective jet breakup, a respective angle is described which the respective injection jet assumes in its spatial expansion starting from the injector. In particular, the jet breakup, along with the injection pressure, can be influenced by a geometrical shape of the injection openings. Furthermore, roundness and conicity of the injection openings have an influence on the jet breakup.

In order to achieve a particularly efficient and thus fuel-efficient operation, it is provided in a further design of the invention that the first injection jets reach further into the combustion chamber than the respective second injection jets. In doing so, a particularly advantageous combustion can be achieved. Reaching further into the combustion chamber is to be understood as meaning that, starting from the injector, the first injection jets penetrate deeper into the combustion chamber than the second injection jets, such that the first injection jets, for example, extend further away from the injector than the second injector jets. Advantageously, the combustion air in the combustion chamber can be mixed with the second injection jets in the region around the injector, such that combustion air not consumed by the third combustion fronts in the direction of the injector can be mixed with fuel from the second injection jets and forms the fourth combustion fronts in the close region of the injector, whereby a further improved combustion is achieved and the combustion air spatially distributed in the combustion chamber is utilized in a further optimized manner.

A further embodiment is characterised in that the first jet breakups are identical among one another. Alternatively or additionally, it is provided that the second jet breakups are identical among one another. In doing so, the fuel can be injected particularly advantageously into the combustion chamber, such that a particularly optimized combustion can be depicted.

In a particularly advantageous embodiment of the invention, the second injection jets are injected into the combustion in a star shape at least in relation to one another or at least when seen one below the other. In doing so, a particularly optimized combustion can be achieved.

It has been shown to be particularly advantageous when the first injection jets and the second injection jets are injected simultaneously into the combustion chamber and in a star shape in relation to one another or when seen one below the other. In doing so, a particularly optimized combustion can be achieved.

It has been shown to be particularly advantageous when the first injection jets and the second injection jets alternatingly follow on from one another in the peripheral direction of the piston when injecting the injection jets. This means that exactly one second injection jet is arranged between respectively two adjacent first injection jets or exactly one first injection jet is arranged between two second injection jets adjacent in the peripheral direction. Advantageously, the third combustion front and the fourth combustion front form in the gaps between first injection jets, such that no or only a minimal overlap of the first and the second injection jets takes place, whereby a further improved combustion is achieved and the combustion air spatially distributed in the combustion chamber is utilized in a further optimized manner.

It has been shown to be particularly advantageous for a fuel-efficient and low emission operation when the first injection jets are injected with a first jet cone angle in a range of from 130 degrees inclusive to 160 degrees inclusive. In particular, the first jet cone angle is 150 degrees.

In order to be able to achieve a particularly optimized utilization of the combustion air present in the combustion chamber, it is provided in a further design of the invention that the second injection jets are injected with a second injection cone angle in a range of from 100 degrees inclusive to 125 degrees inclusive. Here, it has been shown to be particularly advantageous when the second jet cone angle is 120 degrees.

Advantageously, the different jet cone angles for the first injection jets and the second injection jets respectively enable a different tilting of the respective injection jets in relation to the cylinder head or piston, such that the combustion air of different regions is mixed with injected fuel in the combustion chamber, whereby a further improved utilization of the present combustion air is carried out in the combustion chamber and the combustion of the injected fuel is further improved in the combustion chamber.

In order to develop an internal combustion engine of the kind herein in such a way that a particularly advantageous and in particular optimized combustion can be achieved, it is provided according to the invention that first deflection means are arranged in the piston stage by means of which the injection jets can be divided into third subsets and/or second deflection means are arranged which deflect the third subset from the peripheral direction in the radial direction inwardly and, in particular, in the direction of the piston hollow. Furthermore, the first injection jets are formed with respective first jet breakups, and, by means of the injector, several second injection jets provided in addition to the first injection jets with respective second jet breakups can be simultaneously injected directly into the combustion chamber for the combustion process. Advantages and advantageous designs of the method according to the invention are to be seen as advantages and advantageous designs of the internal combustion engine according to the invention and vice versa.

Further advantages, features and details of the invention emerge from the description below of a preferred exemplary embodiment and by means of the drawings. The features and combinations of features mentioned above in the description and the features and combinations of features mentioned below in the description of the figures and/or shown only in the figures can not only be used in the respectively specified combination, but rather also in other combinations or individually, without leaving the scope of the invention.

DETAILED DESCRIPTION OF THE DRAWINGS

Figure 1:
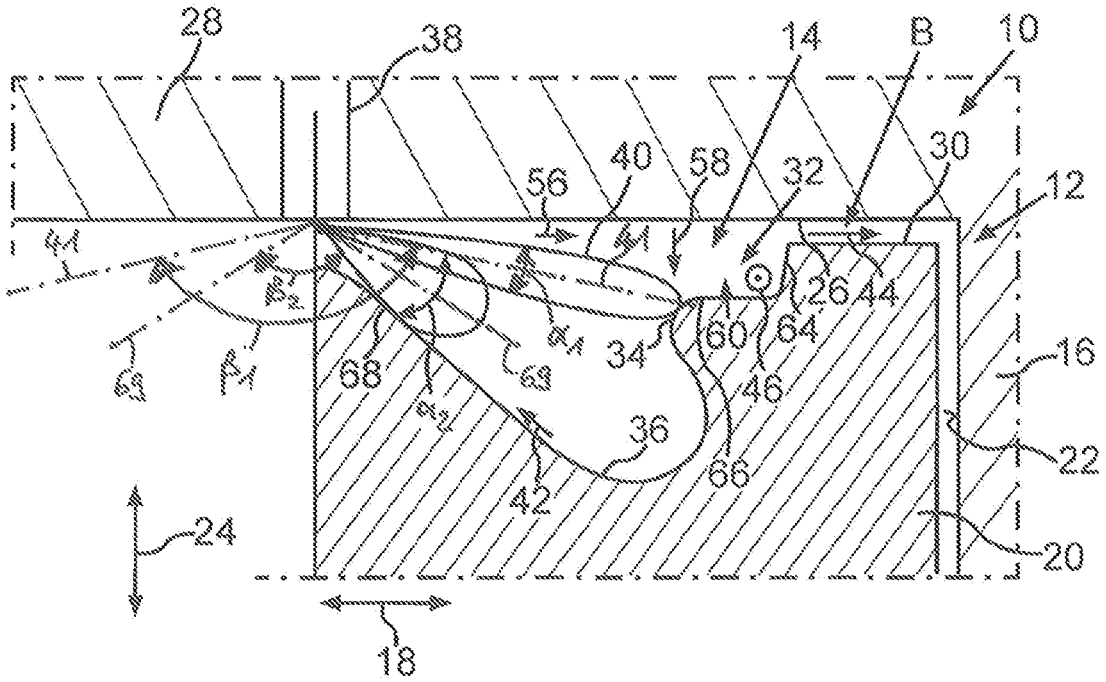
FIG. 1 shows, sectionally, a schematic side view of an internal combustion according to the invention for a motor vehicle.

In the figures, the same or functionally identical elements are provided with the same reference numerals.

In a schematic sectional view, FIG. 1 sectionally shows an internal combustion engine 10 formed as a stroke piston engine for a motor vehicle, such as a passenger vehicle or a commercial vehicle, for example. Here, the motor vehicle can be driven by means of the internal combustion engine 10. The internal combustion engine 10 has at least one cylinder 12, the combustion chamber 14 of which is delimited in the radial direction of the cylinder 12 by a cylinder wall 16. The radial direction of the cylinder 12 is illustrated in FIG. 1 by a double arrow 18. The cylinder wall 16 is formed, for example, by a cylinder housing, formed in particular as a cylinder crank housing, of the internal combustion engine 10. The combustion chamber 14 is delimited in the axial direction of the cylinder 12 by a piston 20 of the internal combustion engine 10 that can be received translationally moveably in the cylinder 12. In particular, the cylinder wall 16 forms a track 22, wherein the piston 20 can be supported on the track 22 in its radial direction and thus in the radial direction of the cylinder 12. The axial direction of the cylinder 12 coincides with the axial direction of the piston 20, wherein the radial direction of the cylinder 12 coincides with the radial direction of the piston 20.

The combustion chamber 14 is delimited in the axial direction of the cylinder 12 opposite the piston 12 by a combustion chamber roof 26 of the internal combustion engine 10. The combustion chamber roof 26 is formed, for example, by a cylinder head 28 of the internal combustion engine 10. The cylinder head 28 is, for example, a component formed separately from the cylinder housing and connected to the cylinder housing. Since the piston 20 is received translationally moveably in the cylinder 12, the piston 20 can be moved forwards and backwards between an upper dead center and a lower dead center in the axial direction of the cylinder 12 in relation to the cylinder wall 16, such that the piston 20 can be stroke adjusted.

The piston 20 has an annularly peripheral piston stage 32 which is arranged axially recessed in the piston 20 in comparison with an annularly peripheral piston crown 32 of the piston 20 and which merges into a piston hollow 36, arranged axially recessed in the piston 20 in relation to the piston stage 32, of the preferably integrally formed piston 20 via an annularly peripheral jet splitter contour 34 of the piston 20. The respective feature of the piston stage 32 being axially recessed in comparison with the piston crown 32 or that the piston hollow 36 is arranged to be axially recessed in relation to the piston crown 32 is to be understood to mean that the piston stage 32 is recessed in comparison with the piston crown 30 in the axial direction of the piston 20 and thus in the axial direction of the cylinder 12 or set back towards the piston hollow 36 or that the piston hollow 36 is set back in the axial direction of the piston 20 and thus in the axial direction of the cylinder 12 away from the combustion chamber roof 26 in comparison with the piston stage 32.

Furthermore, at least or exactly one injector 38 of the internal combustion engine 10 is allocated to the combustion chamber 14. The injector 38 is held on the cylinder head 28 and here arranged at least partially, in particular at least substantially or completely, in the cylinder head 28.

The piston 20 is coupled, for example flexibly, with an output shaft, formed as a crankshaft, of the internal combustion engine 10. The crankshaft can be rotated around an axis of rotation in relation to the cylinder housing. As a result of the flexible coupling of the piston 20 with the crankshaft, the translational movements of the piston 20 in the cylinder 12 are converted into a rotational movement of the crankshaft around its axis of rotation, whereby the crankshaft rotates around its axis of rotation in relation to the cylinder housing. Here, the internal combustion engine 10 is formed as a four-stroke engine, such that a respective work cycle of the internal combustion engine 10 comprises 720 degrees of crank angle, i.e., exactly two complete rotations of the crankshaft. Within the respective work cycle, at least one combustion process or several combustion processes proceed in the combustion chamber 14, as part of which a fuel-air mixture is combusted. In doing so, the piston 20 is driven, whereby the crankshaft is driven and thus rotated around its axis of rotation in relation to the cylinder housing. As is explained in more detail below, the fuel-air mixture comprises air which flows into or is introduced into the combustion chamber 14. Moreover, the fuel-air mixture comprises a fuel which is injected within the respective work cycle directly into the combustion chamber 14 by means of the injector 38. The fuel is preferably a liquid fuel. Furthermore, additionally returned exhaust gas can be present in the combustion chamber 14 if an exhaust gas return is provided. Preferably, the internal combustion engine 10 is formed as a self-igniting internal combustion engine, in particular as a diesel engine, such that the fuel is a diesel fuel. A method for operating the internal combustion engine 10 is described below, wherein the internal combustion engine 10 is operated in a fired operation during the method or by means of the method, during which the at least or preferably exactly one combustion process proceeds in the combustion chamber 14 within the respective work cycle. Thus, the method is a combustion method according to which the internal combustion engine 10 is operated in its fired operation. In particular, the internal combustion engine 10 is operated in a self-igniting operation during the method or by means of the method, as part of which the fuel-air mixture or a fuel-air-exhaust gas mixture is ignited in an independently sparking manner, i.e., without using an external ignition device, such as a spark plug, for example.

Figure 2:
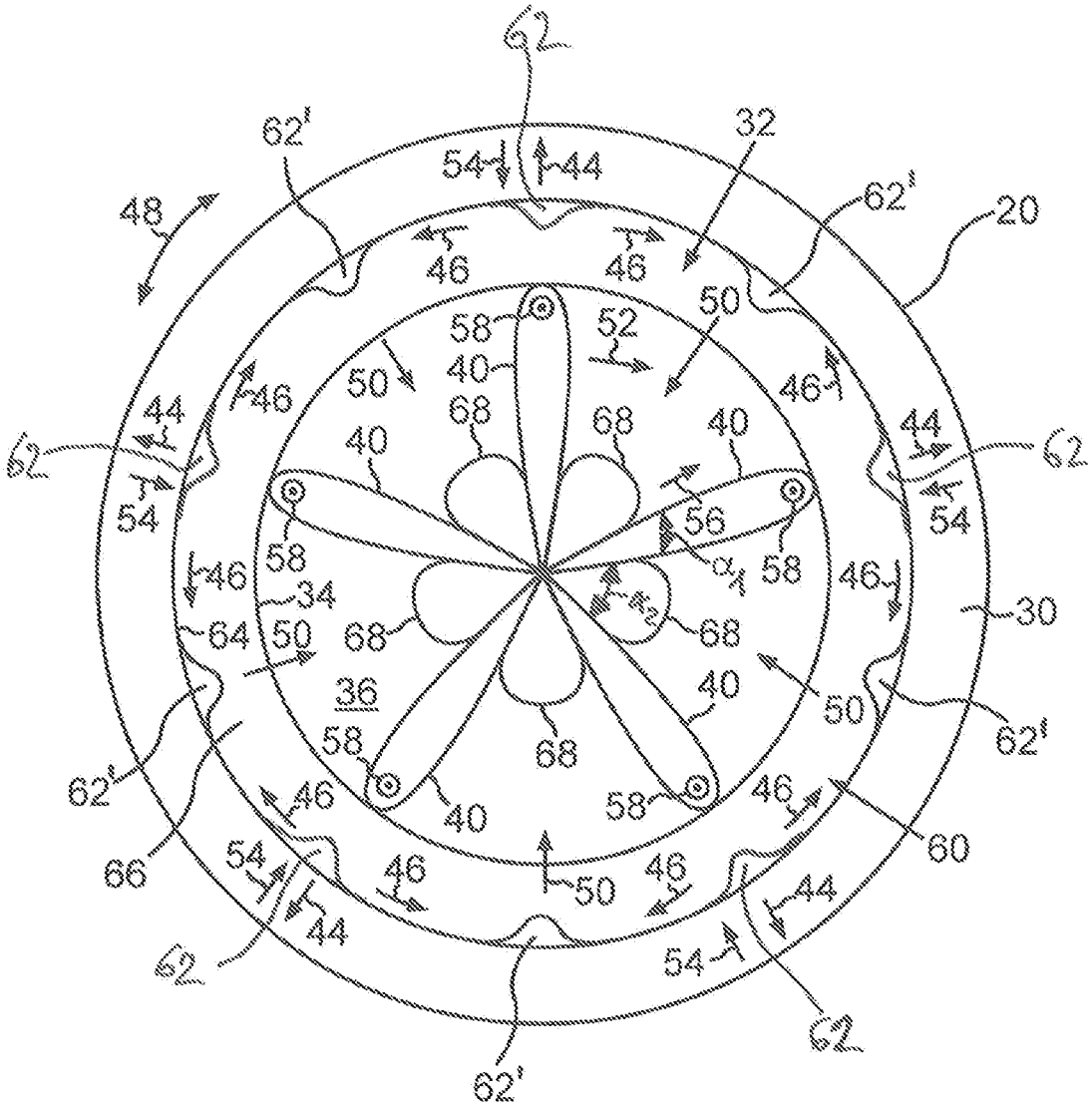
FIG. 2 shows, sectionally, a schematic top view of a combustion chamber of the internal combustion engine.

Within the respective work cycle for the respective combustion process, several first injection jets 40 are simultaneously injected by means of the injector 38 directly into the combustion chamber 14 in the shape of a star along their respective longitudinal central axes 41, which can be seen particularly well when seen together with FIG. 2. Here, in FIGS. 1 and 2, the first injection jets 40 are shown when impinging on the jet splitter contour 34. In the further course of the injection, in particular during the first expansion of the injection jets into the combustion chamber 14, the respective first injection jet 40 is divided by means of the jet splitter contour 34 into a first subset 42 entering into the piston hollow 36 (depicted as an arrow), into a second subset 44 entering into a region B between the piston crown 30 and the combustion chamber roof 26 via the piston stage 32 (depicted as an arrow) and into third subsets 46 (depicted as an arrow) (FIG. 2). The at least or exactly two third subsets 46 expand starting from the respective first injection jet 40 on both sides in the peripheral direction of the piston 20 in opposite directions along the piston stage 32 and collide between two adjacent injection jets 40 and are thus radially, i.e., in the radial direction of the piston 20, deflected inwardly in the direction of the injector 38. Here, the peripheral direction of the piston 20 is illustrated in FIG. 2 by a double arrow 48, wherein the peripheral direction runs around the axial direction, for example.

The respective injection jet 40 and thus the subsets 42, 44 and 46 are formed by respective parts or fuel parts of the fuel, which is injected within the respective work cycle by means of the injector 38 directly into the combustion chamber 14. Thus, the fuel is injected directly into the combustion chamber 14 within the respective work cycle by means of the injector 38 by forming the injection jets 40. The first subset 42 forms a first combustion front, and the second subset 44 forms a second combustion front. The respectively third subsets 46 deflected inwardly together form a third combustion front radially outwards into a gap 50 between the injection jets 40 or between two adjacent injection jets 40. A resulting current 58 (depicted as an arrow) formed from a swirl 52 (depicted as an arrow), a crushing gap current 54 (depicted as an arrow) and a jet current 56 (depicted as an arrow) deflect the injection jets 40 up-jet or upstream of the jet splitter contour 34 in the direction of the piston 20, such that the injection jets 40 furthermore impinge on the piston 20 with a piston 20 moving away from the cylinder head 28 in the expansion stroke substantially further into the region of the jet splitter contour 34.

In order to now be able to achieve a particularly effective combustion by optimally utilizing the combustion air present in the combustion chamber 14, first deflection means 62 and, alternatively to or in combination with the first deflection means, second deflection means 62' are arranged in the piston stage 32, in particular in its stage chamber 60. Here, the first deflection means 62 divide the injection jets 40 striking the jet splitter contour 34 into third subsets 46 or, with the division into the third subsets 46, support them. The second deflection means 62' can deflect the respective third subset 46 in the radial direction inwardly. It can be seen from FIG. 2 that the respective first deflection means 62 and the second deflection means 62' are formed as a jet splitter or a nose. Moreover, it can be seen particularly well from FIG. 1 and FIG. 2 that the piston stage 32 has a stage wall 64, also referred to as a side wall, by means of which the piston stage 32 or the stage chamber 60 is delimited outwardly in the radial direction of the piston 20. Furthermore, the piston stage 32 has a stage floor 66, also referred to as the floor, by means of which the piston stage 32 or the stage chamber 60 is delimited in the axial direction of the piston 20 downwardly in opposition to the cylinder head 28. The respective nose here projects in the radial direction of the piston 20 outwardly from the stage wall 64 and in the axial direction of the piston 20 on the stage floor 66. Thus, the respective deflection means 62 and 62' protrude from the stage wall 64 in the radial direction inwardly towards the stage chamber 60 and are connected to the stage floor 66. Furthermore, the first deflection means 62 are provided at an impingement point of the injection jets 62 on the jet splitter contour 34 in the piston stage 32 in the stage chamber 60, and the second deflection means 62' are provided substantially starting from the injector 38 respectively centrally between two adjacent first injection jets 40 in the piston stage 32 in the stage chamber 60.

Moreover, the first injection jets 40 are injected directly into the combustion chamber 14 in the form of jet cones with a respective first jet breakup $\alpha_1$. To do so, the injector 38, for example, has first injection openings not described in more detail, via which the first injection jets 40 are injected directly into the combustion chamber 14. Thus, the first injection jets 40 are caused by means of the first injection openings, such that the first injection openings cause the respective first jet breakups $\alpha_1$.

Moreover, several second injection jets 68 provided in addition to the first injection jets 40 are simultaneously injected directly into the combustion chamber 14 with a respective second jet breakup $\alpha_2$ by means of the injector 38 for the combustion process or within the respective work cycle. Here, the respective first jet breakups $\alpha_1$ differ from the respective second jet breakups $\alpha_2$. The first injection jets 40 point along a respective first longitudinal central axis 41 in their injection direction of the respective first injection jets, are narrower or have a further expansion than the respective second injection jets 68 along a respective second longitudinal axis 69 in their injection direction of the respective second injection jets 68. In other words, the second injection jets 68, for example, are thus bushier or more bulbous with a thick jet lobe than the first injection jets 40 and have a greater jet breakup $\alpha_2$ with a further expansion transversely to its second longitudinal central axis 69 than the first injection jets 40 with a thin jet lobe, which has a smaller jet expansion transverse to its first longitudinal central axis 41. For this, the injector 38 has, for example, second injection openings not referred to in more detail provided in addition to the first injection openings, by means of which or via which the second injection jets 68 are injected directly into the combustion chamber 14. Thus, the second injection openings each cause a second injection jet 68 which respectively forms an injection jet 68 with a respective second jet cone angle $\alpha_2$. Here, the second injection jets 68 are flushed by the injector 38 in the direction of the piston 36 as a fourth subset based on an axial direction of the piston 20 in a jet cone angle $\beta_2$ different from the first injection jets 40. The fourth subsets formed by the respective second injection jets 68 each form a fourth combustion front.

For example, a first part of the fuel, which is injected directly into the combustion chamber 14 within the respective work cycle by means of the injector 38, is injected through the first injection openings and thus directly into the combustion chamber 14 via the first injection openings. The first part of the fuel thus forms the first injection jets 40. Furthermore, for example, a second part of the fuel, which is injected directly into the combustion chamber 14 by means of the injector 38 within the respective work cycle, is injected through the second injection openings and thus injected directly into the combustion chamber 14 via the second injection openings. Here, the second part of the fuel forms the respective second injection jets 68. The first part and the second part form, for example, the fuel in total, which is injected directly into the combustion chamber 14 within the work cycle by means of the injector 38 in total. If further injections of first injection jets 40 and second injection jets 68 are injected into the combustion chamber 14 within a work cycle, all first and second parts form the sum of the fuel that is injected into the combustion chamber 14.

As can be seen particularly well from FIG. 2, the first injection jets 40 are injected into the combustion chamber 14 in the shape of a star when seen one below the other or in relation to one another. The second injection jets 68 are also injected into the combustion chamber 14 in the shape of a star when seen one below the other or in relation to one another. Moreover, it is provided that the first injection jets 40 and the second injection jets 68 are simultaneously injected into the combustion chamber 14 in the shape of a star in relation to one another.

Moreover, the first injection jets 40 are longer than the second injection jets 68. In particular, the first injection jets 40 reach further into the combustion chamber 14 than the second injection jets 68. Furthermore, the second injection jets 68 are wider than the first injection jets 40 and are thus bushier or more bulbous. The first jet breakups $\alpha_1$ are the same and the second jet breakups $\alpha_2$ are the same, such that the respective first jet breakup $\alpha_1$ differs from the respective second jet breakup $\alpha_2$.

It has been shown to be particularly advantageous when the first injection jets 40 with a first jet cone angle $\alpha_1$ are injected into the combustion chamber 14. The jet cone angle $\beta_1$ includes the angle which the first injection jets 40 enclose. The respective first jet cone angle $\beta_1$ ranges from 130 degrees inclusive to 160 degrees inclusive and can be, in particular, 150 degrees, while, for example, the respective second jet cone angle $\beta_1$ ranges from 100 degrees inclusive to 125 degrees inclusive and can be, in particular, 120 degrees.

Moreover, it is provided that, when injecting the first injection jets 40 and the second injection jets 68, alternatingly follow on from one another in the peripheral direction of the piston 20 and thus the cylinder 12.

It can be seen particularly well in FIG. 1 that the respective first injection jet 40 is a narrow jet with high impulse, high K-factor and high he-rounding. The respective second injection jet 68 is a bushy jet with low impulse, low K-factor, i.e., low conicity and low he-rounding.

The respective injection jet 40 or 68 is formed by a respective fuel mass, also referred to as the injection mass, of the fuel. Here, the distribution of the injection masses between the injection jets 40 and 68 is conceivable in such a way that it corresponds to the mass of the combustion air available in this chamber, in particular in the chamber in which the respective injection jets 40 and 68 expand. Thus, a particularly advantageous combustion can be ensured.

LIST OF REFERENCE CHARACTERS

10 Internal combustion engine
12 Cylinder
14 Combustion chamber
16 Cylinder wall
18 Double arrow
20 Piston
22 Track
24 Double arrow
26 Combustion chamber roof
28 Cylinder head
30 Piston crown
32 Piston stage
34 Jet splitter contour
36 Piston recess
38 Injector
40 Injector jet
41 Longitudinal central axis
42 First subset
44 Second subset
46 Third subset
48 Double arrow
50 Gap
52 Swirl
54 Crushing gap current
56 Jet current
58 Resulting current
60 Stage chamber
62, 62' Deflection means
64 Stage wall
66 Stage floor
68 Second injection jet, fourth subset
69 Longitudinal central axis
$\alpha_{1,2}$ Jet breakup
$\beta_{1,2}$ Jet cone angle
B Region

The invention claimed is:

1. A method for operating an internal combustion engine (10) of a motor vehicle, wherein the internal combustion engine comprises:

a cylinder (12) with a combustion chamber (14), wherein the combustion chamber (14) is delimited in a radial direction (18) of the cylinder (12) by a cylinder wall (16), in an axial direction (24) of the cylinder (12) on a first side by a piston (20) received translationally moveably in the cylinder (12), and in the axial direction (24) of the cylinder (12) on a second side by a combustion chamber roof (26) of the internal combustion engine (10);

wherein the piston (20) has an annularly peripheral piston stage (32) which is disposed axially recessed in the piston (20) compared with an annularly peripheral piston crown (30) and which merges via an annularly peripheral jet splitter contour (34) into a piston hollow (36) disposed axially recessed in the piston (20) in relation to the piston stage (32);

an injector (38) allocated to the cylinder (12), wherein via the injector first injection jets (40) are simultaneously injected directly into the combustion chamber (14) in a star shape for a combustion process, wherein the first injection jets (40) are each divided into a first subset (42) entering into the piston hollow (36), into a second subset (44) entering via the piston stage (32) into a region (B) between the piston crown (32) and the combustion chamber roof (26), and into third subsets (46) which expand starting from a respective first injection jet (40) on two sides in a peripheral direction (48) of the piston (20) in opposite directions along the piston stage (32) and collide between two adjacent first injection jets (40) inside the piston stage (32) and are deflected radially inwardly;

wherein the first subset (42) forms a first combustion front and the second subset (44) forms a second combustion front, wherein the third subsets (46) respectively deflected inwardly together form a third combustion front radially inwardly into a gap (50) between the first injection jets (40), and wherein the first injection jets (40) are deflected up-jet of the jet splitter contour (34) in a direction of the piston (20) by a resulting current (58) formed at least from a swirl (52), a crushing gap current (54), and a jet current (56);

wherein the first injection jets (40) are divided into the third subsets (46) by a first deflector (62) in the piston stage (32) and/or the third subsets (46) are deflected inwardly by second deflectors (62') in the piston stage (32) from the peripheral direction (48) in the radial direction (18);

wherein the first injection jets (40) are each injected with a first jet breakup ($\alpha$1);

wherein second injection jets (68) are injected directly into the combustion chamber (14);

wherein the second injection jets (68) are each injected with a second jet breakup ($\alpha$2) different from the first jet breakup ($\alpha$1);

wherein a fourth subset is injected by the second injection jets (68) and a fourth combustion front is formed by the fourth subsets;

wherein the first jet breakup ($\alpha$1) of the first injection jets (40) is smaller than the second jet breakup ($\alpha$2) of the second injection jets (68);

wherein the first injection jets (40) reach further into the combustion chamber (14) than the second injection jets (68) and wherein the second injection jets (68) expand in a close region of the injector (38);

wherein the first injection jets (40) and the second injection jets (68) are simultaneously injected into the combustion chamber (14) in a shape of a star in relation to one another;

wherein when injecting, the first injection jets (40) and the second injection jets (68) alternatingly follow on from one another in the peripheral direction (48) of the piston (10);

and comprising the step of:

distribution of respective injection masses between the first injection jets (40) and the second injection jets (68) such that the respective injection masses correspond to a respective available mass of combustion air in the chamber in which the respective first and second injection jets (40, 68) expand.

2. The method according to claim 1, wherein respective first jet breakups ($\alpha$1) of the first injection jets (40) are a same among one another and/or respective second jet breakups ($\alpha$2) of the second injection jets (68) are a same among one another.

3. The method according to claim 1, wherein the second injection jets (68) are injected into the combustion chamber (14) in a shape of a star in relation to one another.

4. The method according to claim 1, wherein the first injection jets (40) are injected with a first jet cone angle ($\beta$1) which ranges from 130 degrees inclusive to 160 degrees inclusive.

5. The method according to claim 4, wherein the second injection jets (68) are injected with a second jet cone angle ($\beta$2) which ranges from 100 degrees inclusive to 125 degrees inclusive.

* * * * *